US008636854B2

(12) United States Patent
Leuschner et al.

(10) Patent No.: US 8,636,854 B2
(45) **Date of Patent: *Jan. 28, 2014**

(54) METHOD FOR MELT IMMERSION COATING OF A FLAT STEEL PRODUCT MADE OF HIGH STRENGTH STEEL

(75) Inventors: Ronny Leuschner, Dortmund (DE); Manfred Meurer, Rheinberg (DE); Wilhelm Warnecke, Hamminkeln (DE); Sabine Zeizinger, Mülheim (DE); Gernot Nothacker, Dortmund (DE); Michael Ullmann, Bochum (DE); Norbert Schaffrath, Hamm (DE)

(73) Assignee: ThyssenKrupp Steel AG, Duisburg (DE)

( * ) Notice: Subject to any disclaimer, the term of this patent is extended or adjusted under 35 U.S.C. 154(b) by 341 days.

This patent is subject to a terminal disclaimer.

(21) Appl. No.: 12/297,112

(22) PCT Filed: Apr. 26, 2006

(86) PCT No.: PCT/EP2006/061858

§ 371 (c)(1), (2), (4) Date: Mar. 16, 2009

(87) PCT Pub. No.: WO2007/124781

PCT Pub. Date: Nov. 8, 2007

(65) Prior Publication Data

US 2009/0199931 A1 Aug. 13, 2009

(51) Int. Cl.
*C23C 2/28* (2006.01)

(52) U.S. Cl.
USPC ..... 148/533; 148/277; 148/287; 148/537

(58) Field of Classification Search
USPC ..... 148/529–533, 277, 287, 537, 633, 634
See application file for complete search history.

(56) References Cited

U.S. PATENT DOCUMENTS

| | | | | |
|---|---|---|---|---|
| 3,925,579 | A | 12/1975 | Flinchum et al. | 427/320 |
| 5,023,113 | A | 6/1991 | Boston et al. | 427/320 |

(Continued)

FOREIGN PATENT DOCUMENTS

| | | |
|---|---|---|
| DE | 689 12 243 | 6/1994 |
| DE | 695 07 977 | 7/1999 |

(Continued)

OTHER PUBLICATIONS

English language machine translation of JP 08-246121, generated May 2, 2011.*

(Continued)

*Primary Examiner* — Brian Walck
(74) *Attorney, Agent, or Firm* — The Webb Law Firm

(57) ABSTRACT

A method for coating a flat steel product manufactured from a high strength steel with a metallic coating, wherein the flat steel product is initially subjected to a heat treatment, in order then, in the heated state, to be hot-dip galvanized with the metallic coating in a melting bath containing overall at least 85% zinc and/or aluminum. The heat treatment includes heating the steel product in a reducing atmosphere, followed by converting a surface of the flat product to an iron oxide layer by a heat treatment lasting 1 to 10 secs in an oxidizing atmosphere, followed by annealing in a reducing atmosphere over a period of time which is longer than the duration of the formation of the iron oxide layer such that the iron oxide layer is reduced at least on its surface to pure iron, followed by cooling the product to a melting bath temperature.

19 Claims, 1 Drawing Sheet

(56) References Cited

U.S. PATENT DOCUMENTS

| | | | | |
|---|---|---|---|---|
| 5,447,754 | A | 9/1995 | Jasper | 427/320 |
| 5,591,531 | A | 1/1997 | Jasper | 428/610 |
| 2003/0047255 | A1 | 3/2003 | Delaunay et al. | 148/579 |
| 2004/0177903 | A1 | 9/2004 | Francois | 148/533 |

FOREIGN PATENT DOCUMENTS

| | | |
|---|---|---|
| EP | 0 356 783 | 3/1990 |
| EP | 89114828 | 3/1990 |
| EP | 1285972 | 2/2003 |
| GB | 1 231 478 | 5/1971 |
| JP | 2285057 | 11/1990 |
| JP | 8246121 | 9/1996 |

OTHER PUBLICATIONS

International Search Report for International Application No. PCT/EP2007/061858.

Office Action for co-pending U.S. Appl. No. 11/721,138, notification date—May 12, 2011, 11 pages.

English language translation of JPH08-246121 dated Sep. 24, 1996, 20 pages.

* cited by examiner

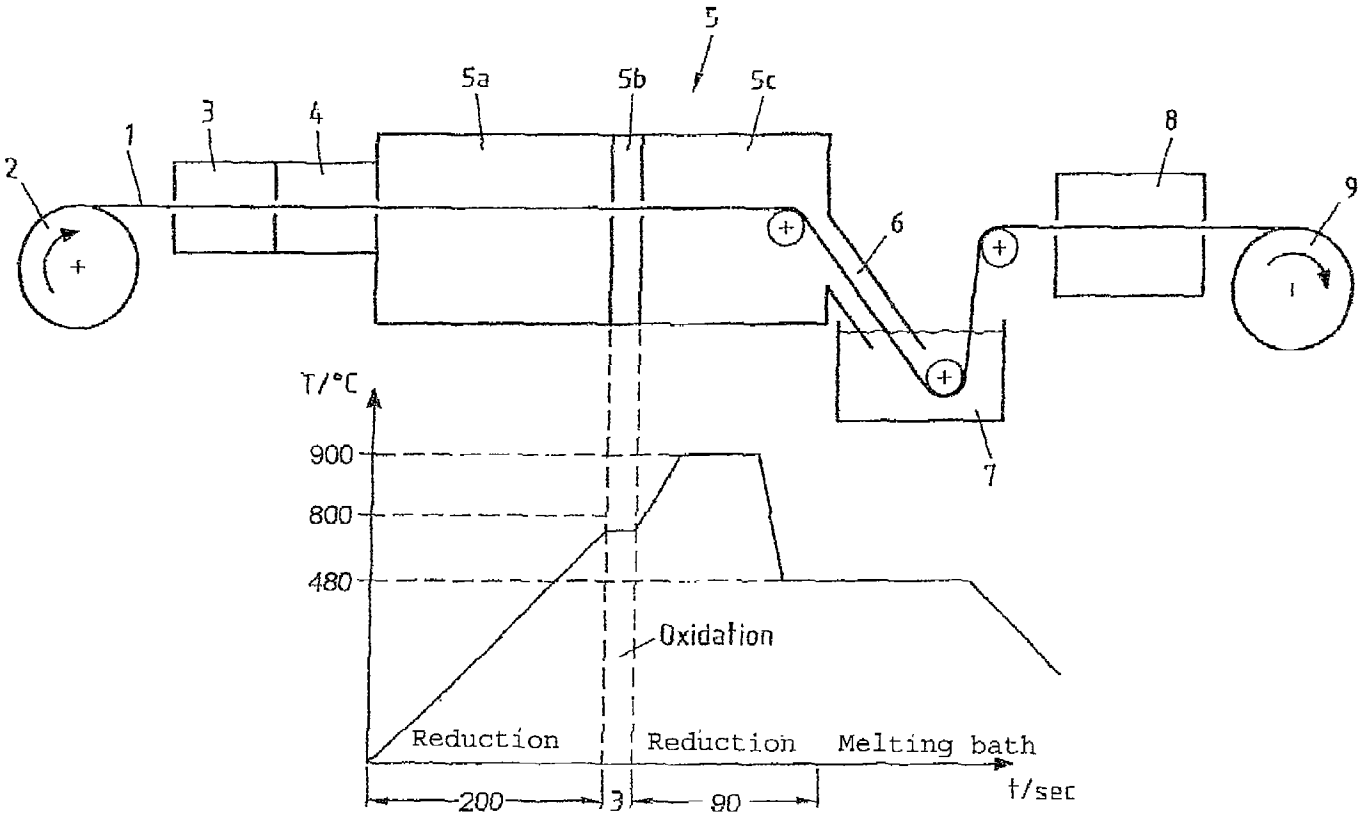
1
2
3
4
5
5a
5b
5c
6
7
8
9
T/°C
900
800
480
Oxidation
Reduction
Reduction
Melting bath
t/sec
200
3
90

METHOD FOR MELT IMMERSION COATING OF A FLAT STEEL PRODUCT MADE OF HIGH STRENGTH STEEL

CROSS-REFERENCE TO RELATED APPLICATIONS

This application is a National Phase Application of International Application No. PCT/EP2006/061858, filed on Apr. 26, 2006. The disclosure of the above application is incorporated herein by reference in its entirety.

FIELD OF THE INVENTION

The invention relates to a method for the coating of a flat steel product manufactured from a high strength steel containing different alloy constituents, in particular Mn, Al, Si, and/or Cr, such as steel strip or sheet, with a metallic coating, wherein the flat steel product is subjected to a heat treatment in order then, in the heated state, to be provided with the metallic coating by hot-dip coating in a melting bath containing overall at least 85% zinc and/or aluminum.

BACKGROUND

In automobile bodywork construction, hot or cold-rolled sheets made of steel are used which for reasons of corrosion protection are surface-treated. The demands made on such sheets are highly varied. On the one hand, they should be capable of being easily formed, while on the other they should be of high strength. The high strength is achieved by the addition to iron of specific alloy constituents, such as Mn, Si, Al, and Cr.

In order to optimize the properties profile of high strength steels, it is usual to anneal the sheets immediately before the coating with zinc and/or aluminum in the melting bath. While the hot-dip coating of steel strips which contain only small proportions of the alloy constituents referred to is not problematic, difficulties do arise with the hot-dip coating of steel sheet with higher proportions of alloys using conventional methods. Thus, areas occur, for example, in which the coating only adheres inadequately to the individual steel sheet, or which remain entirely uncoated.

In the prior art there has been a large number of attempts to avoid these difficulties. It appears, however, that an optimum solution to the problem has not yet been achieved.

With a known method of hot-dip coating of a strip of steel with zinc, the strip which is to be coated runs through a directly-heated pre-heater (DFF=Directly Fired Furnace). By changing the gas-air mixture at the gas burners used, an increase in the oxidation potential can be created in the atmosphere surrounding the strip. The increased oxygen potential leads to an oxidation of the iron on the surface of the strip. The iron oxide layer formed in this way is reduced in a following furnace stretch. A specific adjustment of the oxide layer thickness on the surface of the strip is very difficult. At high strip speed it is thinner than at low strip speed. In consequence, no clearly defined condition of the strip surface can be produced in the reducing atmosphere. This can in turn lead to adherence problems of the coating to the strip surface.

In modern hot-dip coating lines with an RTF pre-heater (RTF=Radiant Tube Furnace), by contrast with the known system described heretofore, no gas-heated burners are used. Accordingly, pre-oxidation of the iron by a change in the gas-air mixture cannot take place. Rather, in these systems the complete annealing treatment of the strip takes place in an inert gas atmosphere. With such an annealing treatment of a strip made of steel with elevated proportions of alloy constituents, however, these alloy constituents can form diffused oxides on the strip surface which in this case cannot be reduced. These oxides prevent a perfect coating with zinc and/or aluminum in the melting bath.

In the patent literature too, various different methods of hot-dip coating of a steel strip with different coating materials are described.

For example, from DE 689 12 243 T2 a method is known for the continuous hot-dip coating of a steel strip with aluminum, in which the strip is heated in a continuous furnace. In a first zone, surface impurities are removed. To do this, the furnace atmosphere has a very high temperature. However, because the strip runs through this zone at very high speed, it is only heated to about half the temperature of the atmosphere. In the succeeding second zone, which is under inert gas, the strip is heated to the temperature of the coating material aluminum.

In addition to this, from DE 695 07 977 T2 a two-stage hot-dip coating method is known of an alloyed steel strip containing chrome. According to this method, the strip is annealed in a first stage in order to obtain iron enrichment on the surface of the strip. The strip is then heated in a non-oxidizing atmosphere to the temperature of the coating metal.

From JP 02285057 A the principle is also known of zinc coating a steel strip in a multi-stage method. To do this, the pre-cleaned strip is treated in a non-oxidizing atmosphere at a temperature of about 820° C. The strip is then treated at some 400° C. to 700° C. in a weakly oxidizing atmosphere, before it is reduced on its surface in a reducing atmosphere. The strip, cooled to some 420° C. to 500° C. is then galvanized in the usual manner.

SUMMARY OF THE INVENTION

In general, in one aspect, the invention provides a method for the hot-dip coating of a flat steel product manufactured from a high strength steel with zinc and/or aluminum, in which a steel strip with an optimally refined surface can be produced in an RTF system.

In the course of the heat treatment preceding the hot-dip coating, the following method steps according to the invention are run through:

a) The flat steel product (e.g., a strip) is heated in a reducing atmosphere with an $H_2$ content of at least 2% to 8% to a temperature of >750° C. to 850° C.
b) The surface, consisting predominantly of pure iron, is converted into an iron oxide layer by a heat treatment of the strip lasting 1 to 10 secs. at a temperature of >750° C. to 850° C. in a reaction chamber integrated into the continuous furnace, with an oxidizing atmosphere with an $O_2$ content of 0.01% to 1%.
c) The flat steel product is then annealed in a reducing atmosphere with an $H_2$ content of 2% to 8% by heating up to a maximum of 900° C. over a period of time which is that much longer than the duration of the heat treatment carried out for the formation of the iron oxide layer (process step b) such that the iron oxide layer formed previously is reduced at least on its surface to pure iron.
d) The flat steel product is then cooled to melting bath temperature.

Thanks to the temperature guidance according to the invention in step a) the risk is avoided that, during the heating, substantial alloy constituents diffuse to the surface of the flat steel product. Surprisingly, it has transpired that by setting relatively high temperatures, extending to above 750° C. and up to a maximum of 850° C., the diffusion of alloy constituents to the surface is particularly effectively suppressed to the extent that in the following step an efficient iron oxide layer can be formed. This prevents further alloy constituents diffusing to the surface at the subsequent further increased annealing temperature. Accordingly, a pure iron layer can come into existence during the annealing treatment in the reducing atmosphere, which is very well-suited for a full-surface and firmly adhering coating of zinc and/or aluminum.

The result of the operation can be optimized by the iron oxide layer produced in the oxidizing atmosphere being reduced entirely to pure iron. In this state, the coating also has optimum properties with regard to its forming capacity and strength.

According to one embodiment of the invention, during the treatment of the flat steel product on the stretch with the oxidizing atmosphere, the thickness of the oxide layer being formed is measured and, as a function of this thickness and of the treatment time, dependent on the run-through speed of the flat steel product, the $O_2$ content is adjusted in such a manner that the oxide layer can then be reduced fully. A change in the run-through speed of the flat steel product, for example as a result of breakdowns, can in this way be taken into account without any disadvantage to the surface quality of the hot-dip coated flat steel product.

Good results in carrying out the method were achieved when an oxide layer with a thickness of maximum 300 nanometers is produced.

A diffusion of alloy constituents to the surface of the flat steel product can also be counteracted if the heating in step a) of the method according to the invention takes place as rapidly as possible. In one embodiment, good operational results are achieved in particular if the duration of the heating of the flat steel product upstream of the oxidation to more than 750° C. to 850° C. is restricted to a maximum of 300 s, in particular to a maximum of 250 s.

Accordingly, it is advantageous if the heating-up speed of the heating of the flat steel product upstream of the oxidation according to the invention amounts to at least 2.4° C./s, in particular is in the range from 2.4-4.0° C./s.

The heat treatment downstream of the oxidation with subsequent cooling of the flat steel product should, by contrast, last longer than 30 secs., in particular longer than 50 secs., in order to provide a reliably adequate reduction to pure iron of the previously formed iron oxide layer.

As alloy constituents, the high strength steel can contain at least a selection of the following constituents: Mn>0.5%, Al>0.2%, Si>0.1%, Cr>0.3%. Further constituents such as, for example, Mo, Ni, V, Ti, Nb and P can also be added.

With the method guidance according to the invention, the heat treatment of the flat steel product in the reducing atmosphere, both during heating-up as well as during later annealing, lasts several times longer than the heat treatment in the oxidizing atmosphere. In this way the situation is arrived at where the volume of the oxidizing atmosphere is very small in comparison with the remaining volume of the reducing atmosphere. This has the advantage that a reaction can be effected very rapidly to changes in the treatment process, in particular the run-through speed and the formation of the oxidation layer. In practice, therefore, the heat treatment according to the invention of the flat steel product in the reducing atmosphere can be carried out in a continuous furnace, which is equipped with a chamber containing the oxidizing atmosphere, wherein the volume of the chamber can be many times smaller than the remaining volume of the continuous furnace.

The method according to the invention is particularly well-suited for hot-dip galvanizing. The melting bath, however, may also consist of zinc-aluminum or aluminum with silicon additives. Regardless of which melt composition is selected the zinc and/or aluminum content present in each case in the melt in total should amount to at least 85%. Melts composed in this manner are, for example:

Z: 99% Zn
ZA: 95% Zn+5% Al
AZ: 55% Al+43.4% Zn+1.6% Si
AS: 89-92% Al+8-11% Si

In the case of a pure zinc coating (Z), this can be converted by heat treatment (diffusion annealing) into a formable zinc-iron layer (galvanealed coating).

DESCRIPTION

The invention is explained hereinafter in greater detail on the basis of a drawing representing an embodiment.

The only FIGURE shows in diagrammatic form a galvanizing system with a continuous furnace 5 and a melting bath 7. In addition, entered in the FIGURE is the temperature curve for the continuous furnace over the run-through time.

The galvanizing system is intended for the coating in run-through of a flat steel product present in the form of a hot-rolled or cold-rolled steel strip 1, which is manufactured from high strength steel containing at least one alloy element from the group Mn, Al, Si, and Cr, as well as, optionally, further alloy elements for the adjustment of specific properties. The steel can, in particular, be a TRIP steel.

The steel strip 1 is drawn from a coil 2 and conducted through a pickler 3 and/or another system 4 for surface cleaning.

The cleaned strip 1 then runs through a continuous furnace 5 in a continuous operating sequence and is conducted from there via a nozzle element 6, closed off against the ambient atmosphere, into a hot-dip bath 7. The hot-dip bath 7 is formed in the present case by a zinc melt.

The steel strip 1 emerging from the hot-dip bath 7, provided with the zinc coating, passes over a cooling stretch 8 or a device for heat treatment to a coiling station 9, in which it is wound to form a coil.

If required, the steel strip 1 is conducted in meander-fashion through the continuous furnace 5, in order to achieve sufficiently long treatment times with the length of the continuous furnace 5 being kept within practicable limits.

The continuous furnace 5 of the RTF type (RTF=Radiant Tube Furnace) is divided into three zones 5*a*, 5*b*, 5*c*. The middle zone 5*b* forms a reaction chamber and is atmospherically closed off against the first and last zones 5*a*, 5*c*. Its length amounts only to about 1/100 of the total length of the continuous furnace 5. For reasons of better representation, the drawing is not to scale.

Corresponding to the different lengths of the zones, the treatment times of the strip 1 running through is also different in the individual zones 5*a*, 5*b*, 5*c*.

In the first zone 5*a*, a reducing atmosphere prevails. A typical composition of this atmosphere consists of 2% to 8% $H_2$, typically 5% $H_2$, and the remainder $N_2$.

In the zone 5*a* of the continuous furnace 1, the strip is heated to more than 750 to 850° C., typically 800° C. The heating takes place in this situation with a heating-up speed of at least 3.5° C./s. At this temperature and heating-up speed, the alloy constituents contained in the steel strip 1, diffuse in only small quantities to its surface.

In the middle zone 5*b* of the continuous furnace 5 the steel strip 1 is essentially kept at the temperature attained in the first zone 5*a*. The atmosphere of the zone 5*b*, however, contains oxygen, such that oxidation of the surface of the steel strip 1 occurs. The $O_2$ content of the atmosphere prevailing in the zone 5*b* lies between 0.01% and 1%, typically at 0.5%. In this situation, the oxygen content of the atmosphere prevailing in the zone 5*b* is adjusted, for example as a function of the treatment time and the thickness of the oxide layer to be formed on the steel strip 1. If the treatment time is short, for example, then a high $O_2$ content is set, while with longer treatment time, for example, a lower oxygen content can be selected in order to produce an oxide layer of the same thickness.

As a consequence of the fact that the surface of the steel strip 1 is subjected to an atmosphere containing oxygen, the desired iron oxide layer is formed on the surface of the strip. The thickness of this iron oxide layer can be visually assessed, wherein the result of the measurement is drawn on for the adjustment of the individual oxygen content of the zone 5*b*.

Due to the fact that the middle zone 5*b* is very short in comparison with the total furnace length, the chamber volume is correspondingly small. Accordingly, the reaction time for a change in the composition of the atmosphere is short, such that a reaction can be achieved rapidly to a change in the strip speed or to a thickness in the oxide layer deviating from a reference value by a corresponding adjustment of the oxygen content of the atmosphere prevailing in the zone 5*b*. The small volume of the zone 5*b* accordingly allows short adjustment times to be achieved.

In the zone 5*c* following on from zone 5*b* of the continuous furnace 5, the steel strip 1 is heated up to an annealing temperature of about 900° C. The annealing carried out in the zone 5*c* takes place in a reducing nitrogen atmosphere, which has an $H_2$ content of 5%. During this annealing treatment the iron oxide layer prevents, on the one hand, alloy constituents diffusing to the strip surface. Because the annealing treatment takes place in a reducing atmosphere, the iron oxide layer is, on the other hand, converted into a pure iron layer.

The steel strip 1 is further cooled on its further path in the direction of the hot-dip bath 7, such that, on leaving the continuous furnace 5, it has a temperature which is up to 10% higher than the temperature of the hot-dip bath 7, of some 480° C. Because the strip 1, after leaving the continuous furnace 5, consists of pure iron on its surface, it offers an optimum foundation for a firmly adhering bonding of the zinc layer applied in the hot-dip bath 7.

The invention claimed is:

1. A method for coating a flat steel product including alloy constituents with a metallic coating, wherein the flat steel product is initially subjected to a heat treatment, in order then, in the heated state, to be hot-dip coated with the metallic coating in a melting bath including at least 85% zinc and/or aluminum, wherein the heat treatment comprises the following method steps:

a) heating the flat steel product in a reducing atmosphere with an $H_2$ content of 2% to 8% to a temperature of >750° C. to 850° C., a heating-up speed during the heating of the flat steel product upstream of oxidation amounting to at least 2.4° C./s, whereby the heated flat steel product has a surface consisting predominately of pure iron such that an iron oxide layer can be formed on the same surface in the following step;

b) converting said same surface from step a) into an iron oxide layer by a heat treatment of the flat steel product lasting 1 to 10 secs. at a temperature of >750° C. to 850° C. in a reaction chamber integrated into a continuous furnace, with an oxidizing atmosphere with an $O_2$ content of 0.01% to 1%;

c) then annealing the flat steel product in a reducing atmosphere with an $H_2$ content of 2% to 8% by heating to a maximum of 900° C. over a period of time which is longer than the duration of the heat treatment carried out for the formation of the iron oxide layer such that the iron oxide layer formed previously is reduced at least on its surface to pure iron; and d) then cooling the flat steel product to melting bath temperature.

2. The method according to claim 1, wherein the iron oxide layer produced is completely reduced to pure iron.

3. The method according to claim 2, wherein during the heat treatment of the flat steel product with the oxidizing atmosphere, the thickness of the oxide layer being formed is measured and, as a function of this thickness and of treatment time, which is dependent on a run-through speed of the flat steel product, the $O_2$ content is adjusted in such a manner that the oxide layer is then completely reduced during step c).

4. The method according to claim 3, wherein an oxide layer is produced with a thickness of max. 300 nm.

5. The method according to claim 1, wherein the heating of the flat steel product upstream of oxidation to more than 750° C. to 850° C. lasts for a max. 300 secs.

6. The method according to claim 1, wherein the heat treatment downstream of oxidation with following cooling of the flat steel product lasts longer than 30 secs.

7. The method according to claim 1, wherein the steel contains at least one from the group consisting of: Mn>0.5%, Al>0.2%, Si>0.1%, and Cr>0.3%.

8. The method according to claim 1, wherein the heat treatment of the flat steel product in the reducing atmosphere takes place in the continuous furnace integrated with the reaction chamber, wherein the flat steel product passes directly from the first zone to the second zone, and wherein the volume of the reaction chamber is smaller than the remaining volume of the continuous furnace.

9. The method according to claim 1, wherein the flat steel product is heat treated after the hot-dip galvanizing.

10. The method according to claim 1, wherein the heating-up speed amounts to 2.4-4.0° C./s.

11. A method for coating a flat steel product, comprising the following steps:

a) heating the flat steel product in a reducing atmosphere that includes an $H_2$ content of 2% to 8% to a temperature of >750° C. to 850° C., a heating-up speed during the heating of the flat steel product upstream of oxidation amounting to at least 2.4° C./s, whereby the heated flat steel product has a surface consisting predominately of pure iron such that an iron oxide layer can be formed on the same surface in the following step;

b) converting said same surface from step a) into an iron oxide layer by a heat treatment of the flat steel product lasting 1 to 10 secs. at a temperature of >750° C. to 850° C. in an oxidizing atmosphere with an $O_2$ content of 0.01% to 1%;

c) then annealing the flat steel product in a reducing atmosphere that includes an $H_2$ content of 2% to 8% by heating to a maximum of 900° C. over a period of time which is longer than the duration of the heat treatment carried out for the formation of the iron oxide layer such that the iron oxide layer formed previously is reduced at least on its surface to pure iron; and d) hot-dip coating the annealed flat steel product with a metallic coating in a melting bath including at least 85% zinc and/or aluminum.

12. The method according to claim 10, wherein the iron oxide layer produced is completely reduced to pure iron.

13. The method according to claim 10, wherein an oxide layer is produced with a thickness of max. 300 nm.

14. The method according to claim 10, wherein the heating of the flat steel product upstream of oxidation to more than 750° C. to 850° C. lasts for a max. 300 secs.

15. The method according to claim 10, wherein the heat treatment downstream of oxidation of the flat steel product lasts longer than 30 secs.

16. The method according to claim 10, wherein the steel contains at least one from the group consisting of: Mn>0.5%, Al>0.2%, Si>0.1%, and Cr>0.3%.

17. The method according to claim 10, wherein the flat steel product is heat treated after the hot-dip coating.

18. The method according to claim 10, wherein the heating-up speed amounts to 2.4-4.0° C./s.

19. The method according to claim 10, wherein step a) is performed in a first zone of a continuous furnace, and step b) is performed in a second zone of a continuous furnace, and wherein the flat steel product passes directly from the first zone to the second zone.

* * * * *

UNITED STATES PATENT AND TRADEMARK OFFICE

CERTIFICATE OF CORRECTION

PATENT NO. : 8,636,854 B2
APPLICATION NO. : 12/297112
DATED : January 28, 2014
INVENTOR(S) : Leuschner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 730 days.

Signed and Sealed this
Twenty-second Day of September, 2015

Michelle K. Lee

Michelle K. Lee
*Director of the United States Patent and Trademark Office*